US009701468B2

(12) United States Patent
Selig et al.

(10) Patent No.: US 9,701,468 B2
(45) Date of Patent: Jul. 11, 2017

(54) CONTAINER FOR STORING LIQUIDS

(71) Applicant: Wacker Chemie AG, München (DE)

(72) Inventors: Manfred Selig, Burghausen (DE); Geoffrey Leitner, Burghausen (DE); Christoph Hundhammer, Paducah, KY (US); Craig Brown, Paducah, KY (US)

(73) Assignee: WACKER CHEMIE AG, Munich (DE)

( * ) Notice: Subject to any disclaimer, the term of this patent is extended or adjusted under 35 U.S.C. 154(b) by 0 days.

(21) Appl. No.: 15/023,855

(22) PCT Filed: Sep. 19, 2014

(86) PCT No.: PCT/EP2014/070056

§ 371 (c)(1),
(2) Date: Mar. 22, 2016

(87) PCT Pub. No.: WO2015/040193

PCT Pub. Date: Mar. 26, 2015

(65) Prior Publication Data

US 2016/0229625 A1 Aug. 11, 2016

(30) Foreign Application Priority Data

Sep. 23, 2013 (DE) ..... 10 2013 219 072

(51) Int. Cl.

| | |
|---|---|
| ***B65D 90/04*** | (2006.01) |
| ***B65D 88/16*** | (2006.01) |
| ***B65D 88/78*** | (2006.01) |

(52) U.S. Cl.

CPC ..... *B65D 90/046* (2013.01); *B65D 88/16* (2013.01); *B65D 88/1656* (2013.01); *B65D 88/1675* (2013.01); *B65D 88/78* (2013.01); *B65D 2590/046* (2013.01)

(58) Field of Classification Search

CPC .. B65D 90/046; B65D 90/047; B65D 90/048; B65D 90/04; B65D 88/1656; B65D 88/1612; B65D 88/16; B65D 88/1675; B65D 25/16

USPC ..... 220/495.01, 9.1, 495.05, 623, 723, 720, 220/1.6, 1.5, 647, 646

See application file for complete search history.

(56) References Cited

U.S. PATENT DOCUMENTS 1,669,183 A * 5/1928 Wilson ..... B65D 90/30 220/721
2,289,139 A * 7/1942 Marner ..... B65D 90/30 220/723
2,712,797 A * 7/1955 Woehrle ..... B60P 3/426 105/423

(Continued)

FOREIGN PATENT DOCUMENTS

CN 102700735 A 10/2012
DE 2356777 A1 10/1975

(Continued)

*Primary Examiner* — Robert J Hicks
(74) *Attorney, Agent, or Firm* — RatnerPrestia

(57) ABSTRACT

A flexible container for the storage of liquid, where a liquid medium to some extent or completely surrounds the flexible container, characterized in that the base of the flexible container proceeds in the manner of a cone to a discharge point at which liquid can be discharged from the flexible container.

8 Claims, 2 Drawing Sheets

(56) References Cited

U.S. PATENT DOCUMENTS

| | | | | | |
|---|---|---|---|---|---|
| 2,798,639 | A | | 7/1957 | Urban | |
| 3,518,836 | A | | 7/1970 | Itokawa | |
| 4,232,803 | A | * | 11/1980 | Muller | B65D 90/047 220/495.01 |
| 4,917,507 | A | * | 4/1990 | Davidson | B65D 88/1612 383/121 |

FOREIGN PATENT DOCUMENTS

| | | | |
|---|---|---|---|
| WO | 8103011 | A1 | 10/1981 |
| WO | 2008014203 | A1 | 1/2008 |
| WO | 2013030605 | A2 | 3/2013 |

* cited by examiner

CONTAINER FOR STORING LIQUIDS

CROSS-REFERENCE TO RELATED APPLICATIONS

This application is the U.S. National stage filing of International Application No. PCT/EP2014/070056, filed 19 Sep. 2014, and claims priority of German application number 10 2013 219 072.7, filed 23 Sep. 2013, the entireties of which applications are incorporated herein by reference.

FIELD OF THE INVENTION

The invention relates to the use of flexible containers for the storage of liquids, in particular of aqueous polymer dispersions.

BACKGROUND OF THE INVENTION

Infrastructure equipment for the storage of large quantities of liquid is required in a very wide variety of industries, for example in the petroleum industry, the chemical industry and also the food-and-drink industry. The storage capacity of these liquid-storage systems is by way of example 50 000 cubic meters, but a very wide variety of sizes can be provided, depending on each user's requirement. Flexible containers are widely used, by way of example made of plastic or rubber and also termed pillow tanks or flexi-tanks, these being filled with liquid and used for storage by being placed simply on the ground or, to relieve pressure, between embankments. Alternatively, the filled flexible containers can be stored in water basins for protection from mechanical damage caused by the surroundings and to relieve pressure on the flexible containers, as described by way of example in WO-A1 2008/014203. The flexible containers of WO-A1 2008/014203 are of cylindrical design, with flexible side walls and flattened, rigid or stiff bases and, respectively, tops. U.S. Pat. No. 2,798,639 also describes comparable systems. WO-A1 81/03011 discloses spherical flexible containers. In comparison with metal tanks, flexible containers are lighter and moreover foldable, and therefore amenable to faster and simpler installation, and also not susceptible to rusting.

A further challenge consists in finding a simple and efficient method that allows maximum completeness of discharge, from the flexible containers, of liquids located as stored product in these flexible containers, thus also reducing the cost of cleaning of the flexible containers after discharge of the liquids. It is moreover very difficult or indeed impossible to achieve reliable determination of the quantity of liquid located in the flexible containers known hitherto.

SUMMARY OF THE INVENTION

Against this background it was an object to provide infrastructure equipment which can store liquids and which can solve one or more of the abovementioned problems.

The invention provides the use of a flexible container for the storage of liquid, where a liquid medium to some extent or completely surrounds the flexible container, characterized in that the base of the flexible container proceeds in the manner of a cone to a point at which liquid can be discharged from the flexible container (discharge point).

DETAILED DESCRIPTION OF THE INVENTION

Figure 1:
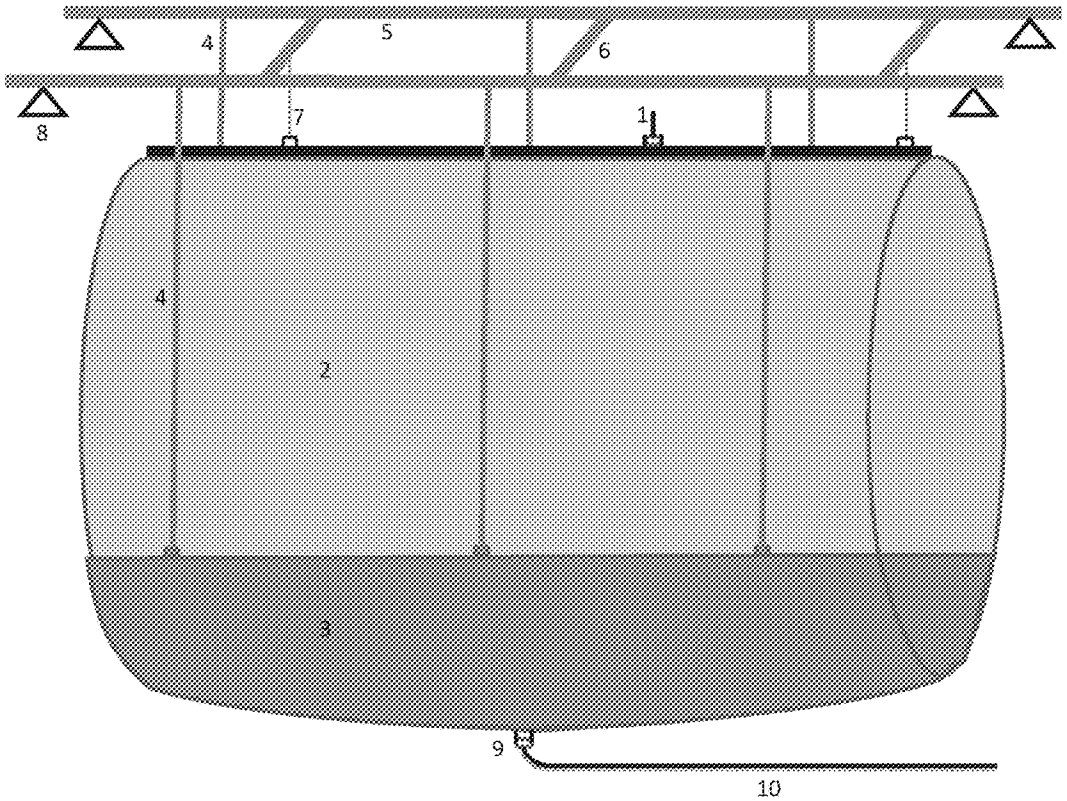
FIG. 1 is a schematic view of a system comprising a flexible container according to the invention.

Another term that can be used for the flexible container is hollow body. The liquid is stored within the hollow interior of the hollow body. Storage means in general terms that the location of the liquid is within the flexible container for a certain time. The capacity of a flexible container is preferably from 2 to 50 000 cubic meters of liquid, particularly preferably from 5 to 3000 cubic meters of liquid and most preferably from 10 to 300 cubic meters of liquid.

The shape of the flexible container is preferably that of a cylinder, sack, pillow or bag having a base which has the shape of a cone to the point at which liquid can be discharged from the flexible container (discharge point). The shape of the flexible container here can also be irregular, deviating from the abovementioned shapes. The flexible container is preferably not square-shaped, rectangular-shaped, block-shaped or round-shaped and in particular not spherical or not ellipsoidal.

The expression "proceeding in the manner of a cone" means that the base of the flexible container, i.e. the underside of the flexible container, narrows or tapers towards the discharge point. Alternative expressions for "in the manner of a cone" are "in the shape of a funnel", "in the shape of a cone", "in the shape of a wedge", and "paraboloid". The base can also be a Klöpper base. The base of a flexible container can also assume the shape of a cone, where the location of the discharge point is at the tip of the cone. The cone is usually a hollow body. The cone can be a truncated, right, or oblique cone, and can deviate in regular or irregular manner from the shape of a cone. The base therefore generally has a gradient towards the discharge point. The gradient of the base is preferably from 5° to 44°, particularly preferably from 10° to 20° and most preferably from 10° to 15°. The location of the discharge point is generally at the lowest point of the base. It is preferable that the flexible container is based on a flexible membrane. The thickness of the flexible membrane is from 2 to 10 mm and particularly preferably from 3 to 5 mm. The flexible membrane is preferably composed of plastics material, optionally in the form of a composite material. Preferred plastics materials are polyvinyl chloride, and preferably polyurethanes, polyester, polypropylene, and rubber, in particular neoprene rubber or nitrile rubber. Examples of composite materials are fibre- or textile-reinforced plastics materials. Suitable materials for fibres are based by way of example on glass, on metals or on organic polymers, in particular polyamide, polypropylene or cellulose. Textile fibres are preferred. The flexible membrane can also be composed of a plurality of layers of identical or different plastics materials and/or composite materials.

The surface(s) of the flexible membrane can also have been coated, for example with plastomers or elastomers, such as polyvinyl chloride or polyacrylonitrile. It is thus possible to improve the robustness of the flexible containers in respect of mechanical loads or chemical stresses caused by liquids to be stored or caused by the liquid medium. The flexible container is generally impermeable to liquids to be stored and to the liquid medium surrounding the flexible container.

The flexible container can have reinforcement at one or more points. For reinforcement there can be another material applied to the flexible container, or the layer thickness of the flexible membrane, for example the plastics material, can be greater at this point, a preferred additional layer thickness being from 1 to 10 mm or from 1 to 5 mm. The reinforcement added to the flexible containers can take the form of rings or of panels or strips. The flexible containers thus become stronger. It is preferable that the region around the discharge point, or the region in which the flexible container proceeds in the manner of a cone, has reinforcement. This region is preferably rigid or not entirely flexible. There is a resultant improvement in ability to achieve maximum completeness of discharge of liquid from the flexible container, leaving no residues. The other regions of the flexible container are generally not stiff, rigid, or inflexible.

The flexible container generally has a plurality of discharge devices, or preferably one discharge device, for example an outlet line, optionally a plurality of filler devices, or preferably one filler device, for example a supply line, optionally one or more sampling devices, optionally one or more temperature-control devices and optionally one or more de-aeration lines and optionally one or more pressure-relief devices.

The discharge device can optionally also be used as filler device. It is preferable that the discharge device and the filler device are not identical. It is preferable that the filler device is opposite the discharge device, i.e. that its location is not at the base of the flexible container. It is preferable that the filler device has been added on the upper side of the flexible container. By way of the discharge device and the filler device, it is possible to discharge liquid from and, respectively, introduce liquid into, the flexible container. The location of the discharge device is at the discharge point. The discharge device or the filler device can comprise one or more pumps.

The flexible container has been partially or preferably completely surrounded by liquid medium or immersed in liquid medium.

Water is in particular suitable as liquid medium. The liquid medium and the liquid that is to be stored are therefore generally different. However, the liquid medium can be another liquid that is to be stored. The liquid medium can therefore also be a product for storage. The temperature of the liquid medium is preferably from 5 to 90° C., particularly preferably from 10 to 40° C. and most preferably from 15 to 30° C. The liquid medium can comprise additives, for example biocides or salts. In the procedure according to the invention there is generally no mixing of the liquid located in the flexible container and the liquid medium located in the rigid container.

The location of the liquid medium is generally within a rigid container, for example a metal container or a basin erected from mineral construction materials, such as concrete.

The location of the flexible container is generally to some extent or preferably completely within a rigid container. This means that the location of a part of the volume of the flexible container, or preferably of the entire volume of the flexible container, is within the rigid container.

The rigid container is preferably a built structure with base, side walls and optionally a roof. There is generally connection between the side walls and the base and the optionally present roof of the rigid container. It is preferable that the walls and base of the rigid container form a coherent or continuous unit, i.e. a built structure without perforations or openings. The rigid container is therefore generally a sealed and leakproof container, so that no liquid medium escapes from the rigid container.

There can be one or more steles erected on the base of the rigid container. The steles are preferably vertical, but can also have been erected obliquely. There are preferably a plurality of steles orientated in one or more, in particular parallel rows. The diameters of the steles are preferably from 10 to 50 cm, particularly preferably from 10 to 20 cm and most preferably from 10 to 20 cm.

On one or more walls of the rigid container and/or on one or more steles there can be one or more supports. Supports can also have been let into the walls of the rigid container. Finally, there can also be supports on the base of the rigid container. The supports are preferably horizontal, but can also have oblique orientation. A plurality of supports can also form a grid. The supports are preferably made of metal. The supports are generally commonly used T-beams.

The flexible containers have preferably been fixed to the rigid containers, particularly preferably to supports. Alternatively, the flexible containers can have been fixed on the roof of a rigid container. These embodiments are particularly suitable when the density of the liquid to be stored is similar to or higher than that of the liquid medium. Alternatively, the flexible containers can also have been fixed on the base of the rigid container. This embodiment is particularly suitable when the density of the liquid to be stored is similar to or lower than that of the liquid medium.

The fixing of the flexible containers to the rigid containers or to the supports can be achieved by way of example by way of one or more retention devices, in particular by means of one or more cables, belts, or chains, or preferably by means of a net. In one preferred embodiment, a net fixed to a retention device envelopes the flexible container. In one particularly preferred embodiment, the fixing is achieved by using a pocket. Here, the location of the flexible container is entirely or preferably partially, in particular in the region of the discharge point or of the base of the flexible container, in a pocket. The materials of which the pocket is composed and/or the manner in which the pocket is constructed can be the same as already described at an earlier stage above for the flexible membrane. It is also possible to add a plurality of fixing systems, in particular a pocket and one or more other fixing systems.

At and/or around the points at which the retention devices have been attached to the flexible containers, it is preferable that abovementioned reinforcements have been added. It is particularly preferable that there are fixing systems and reinforcements located at the underside and/or upper side of the flexible container and, respectively, at the base of and/or at the side opposite to the base of the flexible container and, respectively, in the region or at the side which is the location of the discharge point and/or of the filler device of the flexible container. The region around the filler device and/or around the discharge point is preferably rigid, for example not entirely flexible.

These measures for the fixing and/or reinforcement of a flexible container assist the ability to achieve maximum completeness of discharge of liquid from the flexible container, leaving no residues, while avoiding any development of creasing and resultant pockets of liquid in the flexible container during the course of liquid discharge, where these can be removed from the flexible container only by taking further measures, such as washing steps.

In one preferred embodiment, there are weigh cells, for example commonly used extensometer cells, attached to one or more fixing systems of a flexible container. It is particularly preferable that the flexible container has been fixed to one or more supports which are on weigh cells. In the event that the stored liquid and the liquid medium have different densities under the storage conditions, this provides an easy way of determining the weight and therefore the quantity of the stored product located in the flexible container. By virtue of the hydrostatic pressure of the liquid medium, it is actually possible to use technically simple weigh cells to determine the weight of large quantities of stored liquid reliably and inexpensively.

There can also be a plurality of flexible containers introduced within a rigid container. Another term used for this type of arrangement is "farm". In instances of this type, the rigid container can by way of example have a length of 30 meters and a width of 60 meters or 30 meters. A farm can preferably comprise from 2 to 30 flexible containers, particularly preferably from 5 to 30 and most preferably from 10 to 20.

Within a rigid container, two or more flexible containers can comprise different liquids. The individual flexible containers can have different sizes. Great flexibility is thus achieved in respect of the nature and quantity of the liquids to be stored, and storage logistics are thus simplified.

By means of the discharge device, the liquid is discharged from the flexible container and preferably conducted out of the system by way of the upper side of the rigid container, particularly preferably through the roof of the rigid container. Alternatively, although less preferably, the discharge device and, respectively, the filler device can also be passed through the side wall, or else through the base, of the rigid container.

The flexible container can be used once or preferably more than once for the storage of the same or different liquids. If necessary, the flexible container can be cleaned by flushing with a wash solution, preferably water, after a discharge procedure and before the next fill procedure. The number of flushes is preferably from one to three. Relatively small quantities of wash solution are sufficient for this purpose. Because of the shape according to the invention of the flexible containers it is possible to carry out these flushing procedures more quickly, or to omit them entirely. It is thus possible to store different liquids in succession in the flexible container without cross-contamination, for example as a consequence of residues in the supply lines or discharge lines or in the flexible container itself.

Installation of the rigid container can be entirely or preferably partially subterranean. Above the rigid container there can be other built structures erected, for example measuring stations, office buildings, multi-storey car parks, buildings with production plant, or further storage systems according to the invention or other storage systems. Integration of the rigid container into a building is therefore possible. The location of the rigid container can also be within a ship.

There can be an enclosure surrounding the rigid container. By way of example, the location of all or part of the volume of the rigid container can be within a trough. It is thus possible to avoid contamination of the environment as a consequence of any leak from the rigid container, thus permitting compliance with even higher safety standards.

The flexible container is suitable for the storage of a very wide variety of liquids, such as crude oil, crude oil products, liquids for human consumption, such as milk, fruit juices or wine, or in particular aqueous polymer dispersions, or other organic liquids, such as ethanol. Preferred liquids are liquid at temperatures that are preferably from 5 to 90° C. and particularly preferably from 10 to 30° C.

Polymer dispersions are obtainable by way of example after emulsion polymerization processes. The polymers are preferably produced by free-radical-initiated polymerization of one or more ethylenically unsaturated monomers in an aqueous medium. Polymers are therefore preferably present in the form of aqueous dispersions. The polymers can have stabilization by the commonly used emulsifiers and/or preferably protective colloids, such as polyvinyl alcohols.

Preferred ethylenically unsaturated monomers are selected from the group consisting of vinyl esters, (meth) acrylic esters, vinylaromatics, olefins, 1,3-dienes and vinyl halides and optionally other monomers copolymerizable therewith.

Preference is given to vinyl ester copolymers. Examples of preferred vinyl ester copolymers are based on from 30 to 90% by weight of one or more vinyl esters, from 1 to 40% by weight of ethylene and optionally from 1 to 40% by weight of one or more other comonomers, based on the total weight of the monomers. The other comonomers are preferably the abovementioned monomers other than vinyl esters and other than ethylene.

Preference is given to comonomer mixtures of vinyl acetate with from 1 to 40% by weight of ethylene; and also to comonomer mixtures of vinyl acetate with from 1 to 40% by weight of ethylene and from 1 to 50% by weight of one or more other comonomers from the group of vinyl esters having from 1 to 12 carbon atoms in the carboxylic acid moiety, e.g. vinyl propionate, vinyl laurate, vinyl esters of alpha-branched carboxylic acids having from 9 to 11 carbon atoms, for example VeoVa9, VeoVa10, VeoVa11; and mixtures of vinyl acetate, from 1 to 40% by weight of ethylene and preferably from 1 to 60% by weight of acrylic ester of unbranched or branched alcohols having from 1 to 15 carbon atoms, in particular n-butyl acrylate or 2-ethylhexyl acrylate; and mixtures with from 30 to 75% by weight of vinyl acetate, from 1 to 30% by weight of vinyl laurate or vinyl ester of an alpha-branched carboxylic acid having from 9 to 11 carbon atoms, and also from 1 to 30% by weight of acrylic ester of unbranched or branched alcohols having from 1 to 15 carbon atoms, in particular n-butyl acrylate or 2-ethylhexyl acrylate, which also comprise from 1 to 40% by weight of ethylene; and also mixtures with vinyl acetate, from 1 to 40% by weight of ethylene and from 1 to 60% by weight of vinyl chloride; the total of the data in % by weight is always 100% by weight.

The solids content of the polymer dispersions is preferably from 30 to 70% and particularly preferably from 40 to 60%. The Brookfield viscosities of the polymer dispersions are by way of example 1 mPas and 50 000 mPas (determined at 23° C. by means of a Brookfield viscometer using spindle 5 and 20 revolutions per minute).

The procedure according to the invention has proven to be particularly advantageous for polymer dispersions. Within the flexible containers, the polymer dispersions are less susceptible to bacterial infestation, and the conventional addition of biocides to counter this can therefore be reduced or even entirely omitted. During the conventional storage of polymer dispersions, for example in tanks, skinning, i.e. filming of the polymers, occurs at the boundary between polymer dispersion and environment. This can be avoided by using the procedure according to the invention. These advantages are also accompanied by lower cost for the storage according to the invention of polymer dispersions when comparison is made with conventional storage of these in tanks.

The design according to the invention of the flexible containers promotes capability to achieve maximum completeness and speed of discharge of liquid from the flexible container, and reduces the cleaning cost incurred by any residual quantities of liquid remaining in the flexible container after discharge of the liquid. During discharge of liquid, use of the procedure according to the invention can avoid formation of inclusions resulting from creasing of the flexible container which prevent complete discharge of liquid from the flexible container.

Further advantages are achieved when devices according to the invention have been installed in order to determine the weight, and thus also the volume, of the liquid stored in the flexible container.

The liquid medium can also advantageously serve as medium to cool or heat liquids to be stored. By way of example, a warm or hot liquid to be stored can be charged directly into the flexible container without prior cooling, and can be controlled therein to the desired storage temperature. The storage temperature can be controlled via appropriate temperature-control of the liquid medium.

The concept according to the invention also permits highly efficient utilization of the ground area occupied by buildings, since the area above the rigid container can be used for other uses or to erect other parts of buildings, examples being space for commercial uses, space for parking or else residential space.

Finally, use of the concept according to the invention can avoid perforations in the region of the base or of the walls of the rigid container, with the result that the stored liquids are reliably enclosed, thus intrinsically permitting provision of precautions against any contamination of the environment.

Figure 2:
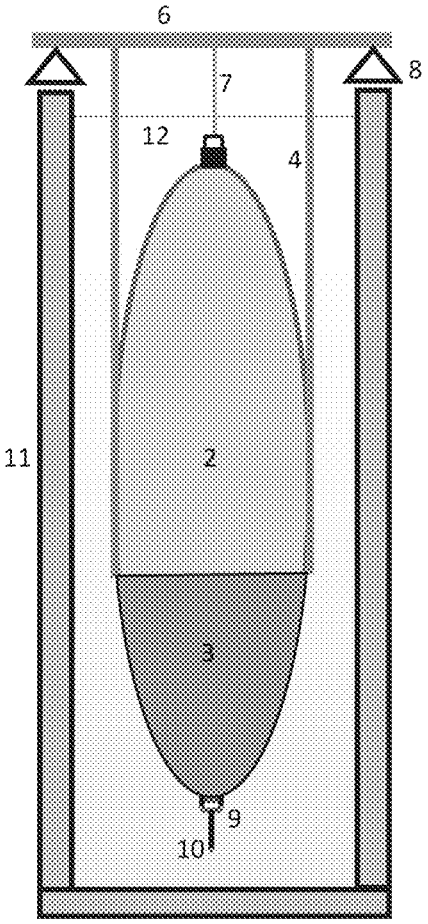
FIG. 2 is a side view of the system depicted in FIG. 1.

The example hereinafter serves for further explanation of the invention:

In a system analogous to that illustrated in FIG. 1, an aqueous dispersion of a vinyl acetate-ethylene copolymer temperature-controlled to 20° C. with 45% solids content was introduced into the flexible container 2 by way of the filler device 1. FIG. 2 is a side view relating to FIG. 1. The flexible container 2 was composed of a membrane of thickness 4 mm made of neoprene rubber. The flexible container 2 had been fixed via the pocket 3, and also via the belts 4 and 7, which in turn had been fixed to the supports 5 and, respectively, 6. The supports 5 and 6 were T beams made of metal and formed a grid. The pocket 3, and also the belts 4 and 7, were composed of neoprene rubber. The supports 5 rested on the weigh cells 8. By using the weigh cells 8 it was possible at any time to determine the weight of the system and thus also of the stored quantity of polymer dispersion. Located at the discharge point 9 was a discharge device with outlet line 10, by way of which the polymer dispersion was in turn discharged from the flexible container.

As depicted in FIG. 2, the location of the flexible container 2 was completely within the rigid container 11, which had been erected from concrete. The liquid medium 12, water at a temperature of 20° C., completely surrounded the flexible container 2.

The invention claimed is:

1. A flexible container for the storage of a liquid, wherein the flexible container is located within a rigid container capable of containing a liquid medium, said liquid medium to some extent or completely surrounding the flexible container, wherein the flexible container is fixed a) to the rigid container and/or b) to one or more supports, said supports being 1) fixed to a wall and/or a base of the rigid container and/or 2) let into a wall of the rigid container and/or 3) fixed to one or more steles erected on a base of the rigid container wherein weigh cells are attached to one or more fixing systems of the flexible container, and wherein the flexible container has a base that proceeds in the manner of a cone to a discharge point at which the liquid can be discharged from the flexible container.

2. The flexible container according to claim 1, wherein the inclination of the gradient of the base of the flexible container towards the discharge point is from 5° to 44°.

3. The flexible container according to claim 1, wherein the flexible container is based on a flexible membrane made of plastic material.

4. The flexible container according to claim 1, wherein the flexible container is fixed to the rigid container and/or to the one or more supports by one or more retention devices selected from the group consisting of cables, belts, chains, nets and pockets.

5. The flexible container according to claim 1, wherein the capacity of the flexible container is from 2 to 50 000 cubic meters.

6. A method for storing a liquid, comprising introducing the liquid into the flexible container according to claim 1.

7. The method according to claim 6, wherein the liquid is selected from the group consisting of crude oil, crude oil products, liquids for human consumption, and aqueous polymer dispersions.

8. The method according to claim 6, wherein the liquid is an organic liquid.

* * * * *